US006971591B2

(12) United States Patent
Fleischmann

(10) Patent No.: US 6,971,591 B2
(45) Date of Patent: Dec. 6, 2005

(54) TAMPER-RESISTANT FLOW MODIFIER ASSEMBLY

(75) Inventor: Gary A. Fleischmann, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 197 days.

(21) Appl. No.: 10/272,752

(22) Filed: Oct. 16, 2002

(65) Prior Publication Data

US 2004/0074992 A1 Apr. 22, 2004

(51) Int. Cl.[7] ..... E03C 1/08
(52) U.S. Cl. ..... 239/428.5; 239/465; 239/580
(58) Field of Search ..... 239/428.5, 461, 239/462, 465, 580, 464, 428.1

(56) References Cited

U.S. PATENT DOCUMENTS

| | | | | |
|---|---|---|---|---|
| 2,986,341 A | | 5/1961 | Goodrie | |
| 3,014,667 A | | 12/1961 | McLean et al. | |
| 3,554,451 A | | 1/1971 | Aghnides | |
| 3,633,824 A | | 1/1972 | Aghnides | |
| 3,851,825 A | * | 12/1974 | Parkison et al. | 239/590.3 |
| 4,221,338 A | * | 9/1980 | Shames et al. | 239/428.5 |
| 4,470,546 A | | 9/1984 | Wildfang | |
| 4,534,513 A | | 8/1985 | Aghnides | |
| 4,534,514 A | | 8/1985 | Aghnides | |
| 4,789,103 A | | 12/1988 | Ruhnke | |
| 4,944,460 A | | 7/1990 | Steingass | |
| 5,071,071 A | * | 12/1991 | Chao | 239/428.5 |
| 5,114,072 A | | 5/1992 | Barhydt, Sr. | |
| 5,201,468 A | * | 4/1993 | Freier et al. | 239/383 |
| 5,242,119 A | | 9/1993 | Jariyasunant | |
| 5,330,105 A | | 7/1994 | Kaylor | |
| 5,467,929 A | | 11/1995 | Bosio | |
| 5,795,475 A | | 8/1998 | Luedke et al. | |
| 6,367,708 B1 | * | 4/2002 | Olson | 239/74 |
| 6,513,731 B2 | * | 2/2003 | Griffin et al. | 239/394 |

OTHER PUBLICATIONS

Applicant's Exhibit A—NEOPERL, Inc.; Waterbury, CT; product information; dated 12/01.
Applicant's Exhibit B—NEOPERL, Inc.; Waterbury, CT; product information; dated 12/01.
Applicant's Exhibit C—NEOPERL, Inc.; Waterbury, CT; product information; dated 12/01.
Applicant's Exhibit D—NEOPERL, Inc.; Waterbury, CT; product information; admitted prior art.

* cited by examiner

*Primary Examiner*—Binh Q. Tran
(74) *Attorney, Agent, or Firm*—Quarles & Brady LLP

(57) ABSTRACT

A tamper resistant aerating/laminarizing assembly includes a slotted, annular retainer piece that threads into the faucet spout or a separate spout extension so that it is recessed back from the opening and thereby hidden and difficult to operate without a special key that fits through the opening to engage the slots. The retainer supports a cartridge, containing flow modifying elements, from its downstream side, rather than from above, so that it is located almost entirely to one side of the cartridge and does not add to the overall diameter of the cartridge.

19 Claims, 3 Drawing Sheets

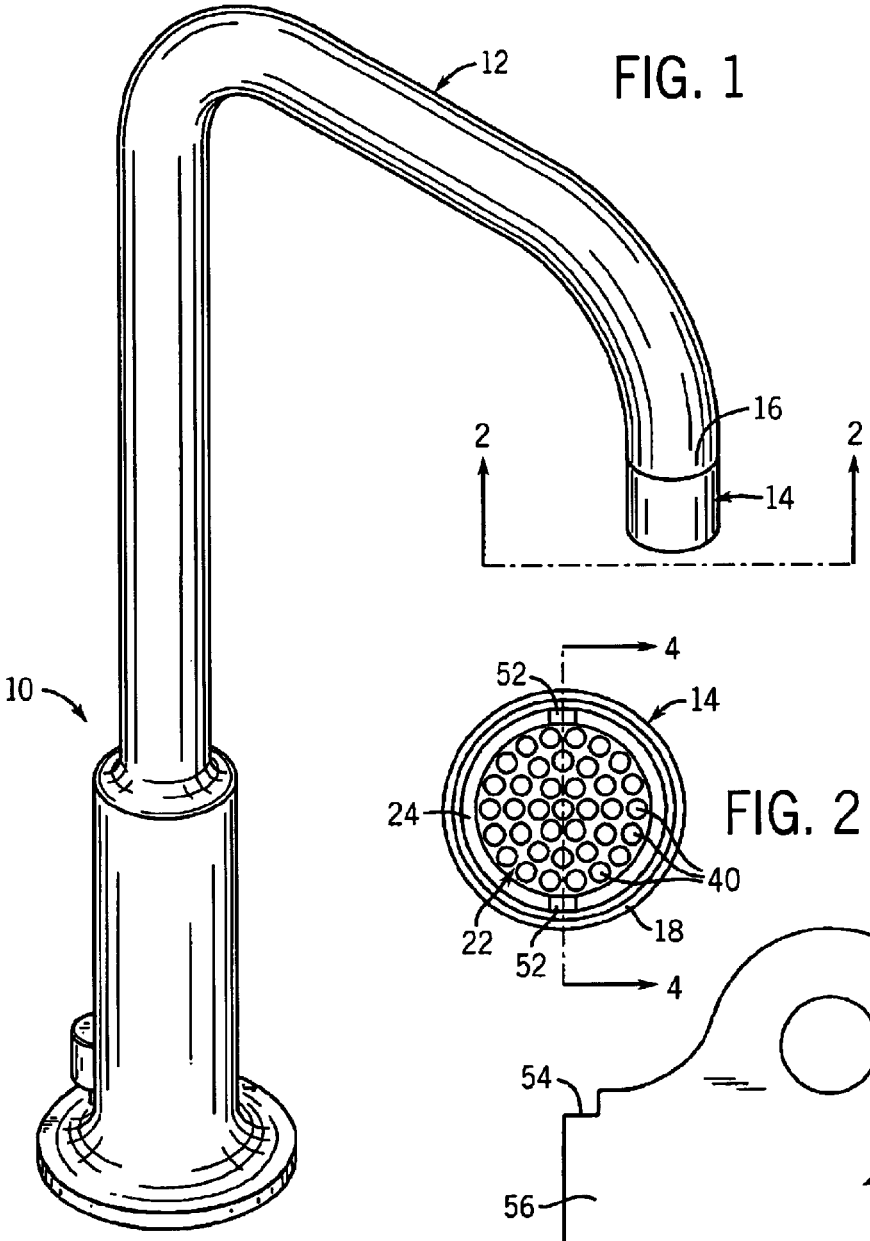
FIG. 1
FIG. 2
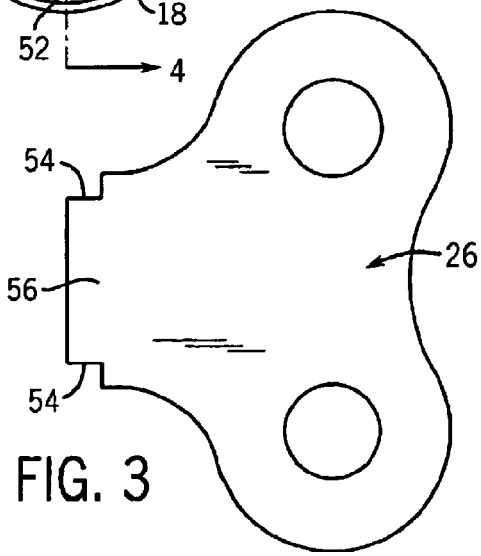
FIG. 3

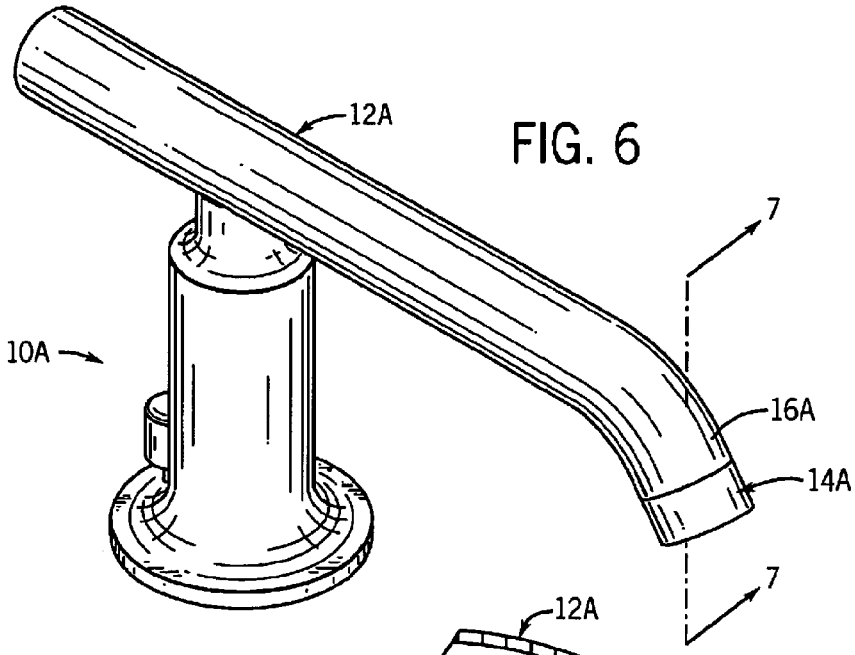
FIG. 6
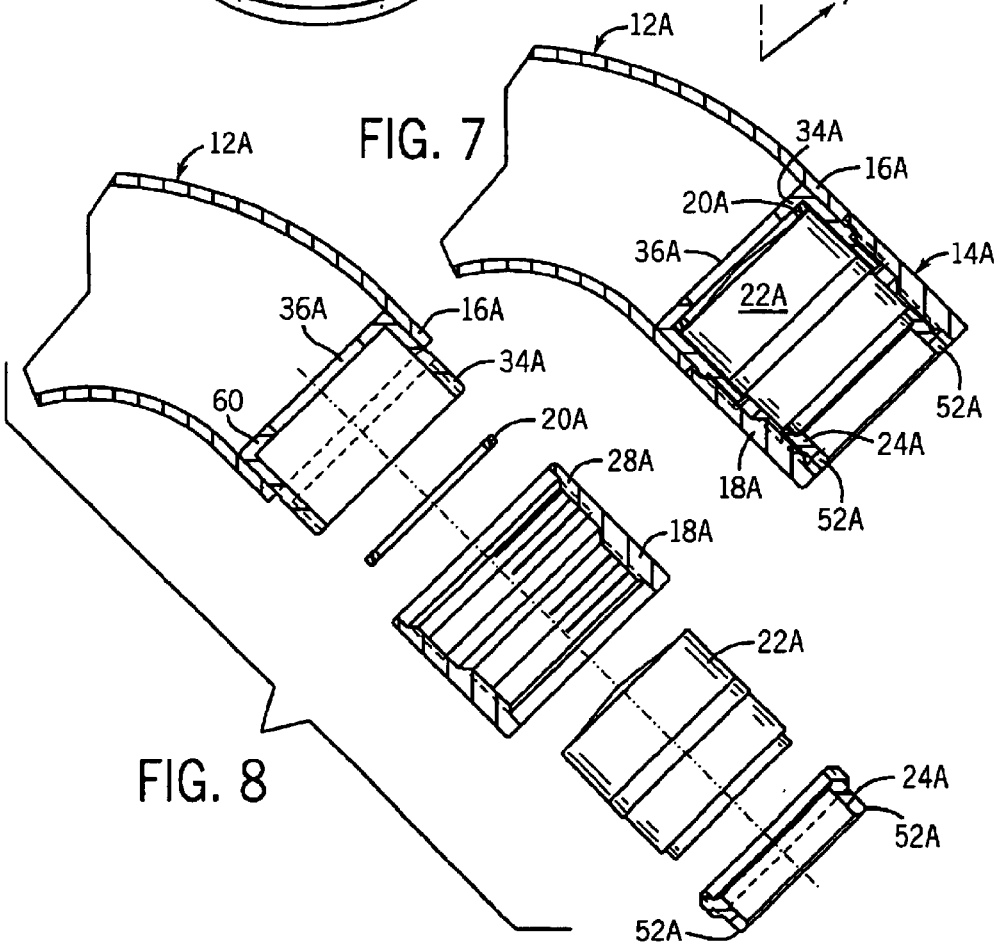
FIG. 7
FIG. 8

TAMPER-RESISTANT FLOW MODIFIER ASSEMBLY

CROSS-REFERENCE TO RELATED APPLICATIONS

Not applicable.

STATEMENT REGARDING FEDERALLY SPONSORED RESEARCH/DEVELOPMENT

Not applicable.

BACKGROUND OF THE INVENTION

The present invention relates to plumbing fixtures. More particularly it relates to assemblies for faucet spouts that modify the flow from the spouts.

It is well-known to place an assembly of components, such as flow restrictors, screens, filters and perforated disks placed spaced apart within the flow path of a faucet spout. These assemblies can have flow smoothing elements that produce a laminar flow exiting the spout. See U.S. Pat. No. 5,242,119, the contents of which, along with that of all other patents referenced herein, are hereby incorporated by reference as through fully set forth herein. The flow smoothing elements alter the flow velocity and redistribute the velocity profile as needed to convert turbulent flow into laminar flow. Or, they can have elements that disrupt the flow and cause turbulence and low pressure to draw air into the water stream to create a soft, bubbly stream flowing from the spout. U.S. Pat. No. 3,554,451 provides an example of one type of faucet aerator assembly.

In either case, the series of flow modifying elements is grouped and supported by in an internal cradle or housing threaded within the spout (or an extension mounted to the open end of the faucet spout). It is common hang this housing from an internal flange so that the assembly cannot pass out of the spout or extension. The assembly is accessed for cleaning or replacement, for example, by unscrewing the housing or the entire extension from the spout. See e.g., U.S. Pat. Nos. 3,554,451; 4,470,546; 4,789,103; and 5,467,929. U.S. Pat. Nos. 4,534,513 and 4,534,514 show flow modifier assemblies that are mounted directly to the faucet spout (without an extension piece) by a cradle threaded at its lower end to the interior of the spout.

One problem encountered is preventing vandalism, especially in public restrooms. There have been some vandal resistant faucets devised that make it difficult to remove the assembly apart from the faucet. Such faucets typically conceal the connection point to the spout or make the operable element inaccessible or unable to be operated by hand or with conventional tools.

U.S. Pat. Nos. 2,986,341 and 3,014,667 are illustrative of two such assemblies. The '341 patent has an outer casing that is counter-bored at its upper end to contain an internally threaded support ring that threads onto the end of the spout. The end of the casing is crimped to capture the support ring while being free to rotate thereabout such that the assembly cannot be removed from the spout by turning the casing. To remove the assembly the support ring must be turned using a special two-pronged tool that inserts into two sets of aligned openings in the casing and the support ring.

The '667 patent teaches an aerator assembly concealed within the faucet spout. The assembly of screens and other elements are placed in a cradle, which threads at its upstream end to the interior of the spout. When tightened in place, this assembly is recessed back from the opening of the spout so that it cannot be see from above the faucet. The assembly is positioned by using a special tool with two prongs that reach into the spout and fit into two keyway openings in the bottom end of the cradle to rotate the assembly.

These assemblies have a threaded ring or cradle around the assembly. The need for this extra component around the flow modifying elements for threading to the spout adds to the overall diameter of the assembly. When used with commercially available standard sized cartridges, in which the elements are packaged inside a self-contained unit, this can leave the assembly with a larger diameter than the spout. The manufacturer thus must increase the diameter of the spout, which may not be desirable or cost effective, to avoid an aesthetically displeasing product.

Thus, a need still exists for a more compact tamper resistant flow modifying assembly.

BRIEF SUMMARY OF THE INVENTION

In one aspect the invention provides a tamper-resistant flow modifier assembly for attachment to a spout. A housing has a threaded end and defines a cavity housing one or more flow modifying elements. A retainer threads into the housing from a downstream side of the housing so that it is recessed within the cavity and supports the flow modifying element from its downstream side. The retainer has a key acceptor.

In one preferred form the flow modifying element is a cartridge insert that can be removed as a single unit from the housing. The cartridge preferably contains multiple elements, such as spaced apart screens and perforated disks. The elements can be flow smoothing elements to render a smooth, clear laminar flow stream or they can cause turbulence and aspirate the stream for a soft, bubbly type stream.

In one preferred form the assembly includes a key having an end sized to fit within the housing and mate with the key acceptor of the retainer to tighten and loosen the retainer so that the cartridge can be removed from the housing. The key acceptor can be defined by a pair of keyways or slots spaced apart 180 degrees in a downstream side of the retainer. The working end of the key has notched corners sized and located to mate with these slots.

In another preferred form the housing and spout have substantially the same outer diameters at least adjacent the joint between them. The assembly provides for especially small diameters, for example, outer diameters of less than 0.75 inches. The diameter being limited primarily by the size of the aerating or laminarizing cartridge; the smallest currently commercially available is believed to have an outer diameter of slightly more than one-half inch (about 0.6 inches).

In other preferred forms the housing is a generally cylindrical open-ended extension of the spout with internal threads such that an upstream end of the housing threads onto an open end of the spout and the downstream end of the spout mates with the threads at the periphery of the retainer. The upstream end of the housing preferably threads onto an adapter piece that fits partially inside the spout. This connection can be secured by a locking material applied between the threads. The assembly can also include a seal disposed in the cavity upstream from the cartridge, and the retainer and the cartridge have inter-fitting ends.

Another aspect of the invention provides a tamper-resistant combined spout and flow modifier assembly for a faucet having a spout with an open end. A tubular spout extension defines a cavity with internal threads at a downstream end and is coupled at an upstream end to the open end of the faucet spout. A cartridge with flow modifying elements is disposed in the cavity and an annular retainer is threaded inside the cavity to support the cartridge from its downstream side. The retainer defines a key acceptor, recessed inside the cavity when the retainer is in place, that can be engaged by a key for rotation of the retainer. Preferably, the spout extension has essentially the same outer diameter as the open end of the spout. As before, a key is provided for rotating the retainer.

The foregoing and other advantages of the invention will appear from the following description. In that description reference is made to the accompanying drawings which form a part hereof and in which there is shown by way of illustration preferred embodiments of the invention. Those embodiments do not represent the full scope of the invention. Rather, the claims should be looked to in order to judge the full scope of the invention.

BRIEF DESCRIPTION OF THE DRAWINGS

FIG. 1 is a perspective view of a faucet spout having a tamper resistant flow modifier assembly according to the present invention;

FIG. 2 is a bottom end view of the assembly;

FIG. 3 is a side view of a key for tightening and loosening a retainer nut of the assembly;

FIG. 6 is a perspective view of an alternate faucet design having an alternate tamper resistant flow modifier assembly;

FIG. 7 is an enlarged partial cross-sectional view showing the assembly of FIG. 6 attached to the faucet spout; and FIG. 8 is a partial exploded cross-sectional view showing the assembly of FIG. 6.

DETAILED DESCRIPTION OF THE PREFERRED EMBODIMENTS

Figure 4:
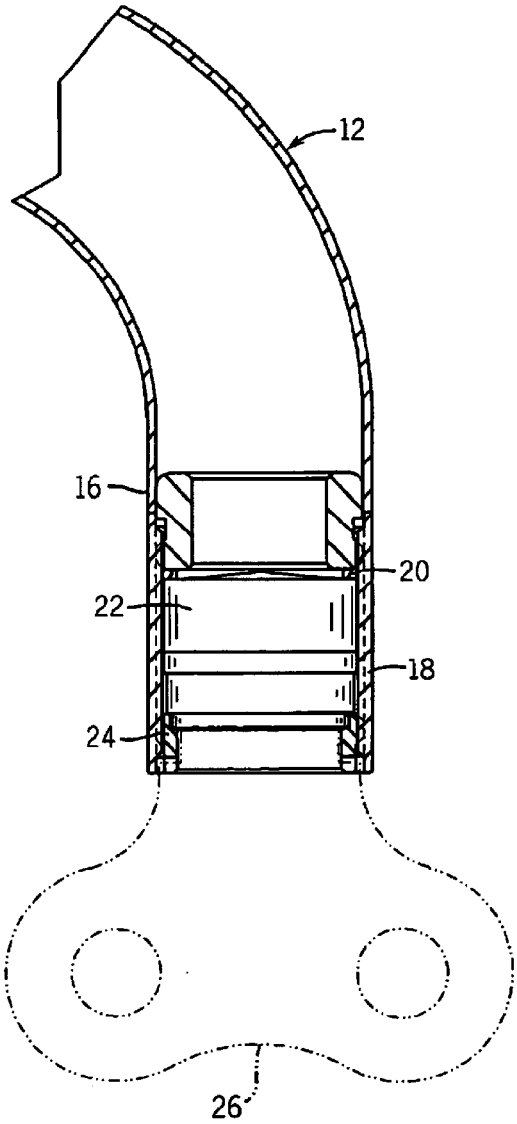
FIG. 4 is an enlarged partial cross-sectional view showing the assembly attached to the faucet spout.
Figure 5:
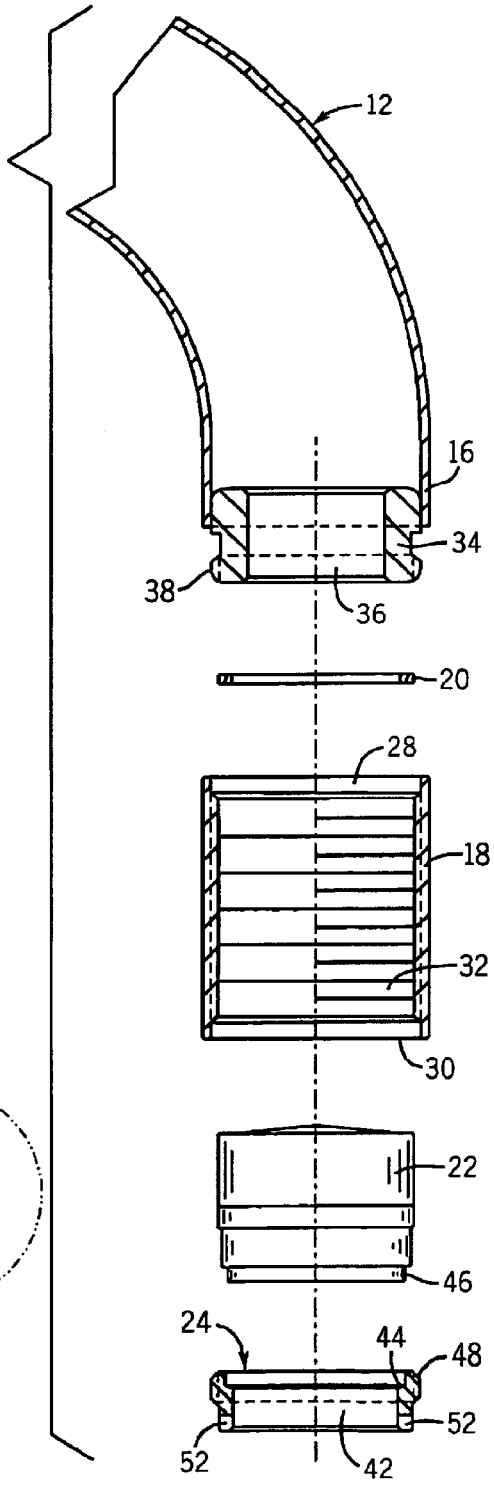
FIG. 5 is a partial exploded cross-sectional view showing the assembly.

FIG. 1 shows a faucet 10 with a generally cane-shaped brass spout 12 to which a flow modifier assembly 14 is attached at an open end 16 of the spout 12. Referring to FIGS. 2 and 4–5, the assembly 14 includes a brass housing or spout extension 18 containing a seal 20, an aerating or laminarizing cartridge 22 and a retainer nut 24. As explained below, the assembly 14 includes a separate key 26 (see FIG. 3) for securing and removing the retainer 24.

More specifically, the spout extension 18 is a generally cylindrical sleeve member open at upstream 28 and downstream 30 ends with internal threads 32 extending substantially between the ends. Preferably, the outer diameter of the spout extension 18 is the same or essentially the same as that of the spout, at least at its open end 16. The inner diameter and the threads 32 at the upstream end 28 of the spout extension 18 are sized to mate with a brass adapter 34 partially inserted into the open end 16 of the spout 12 and permanently mounted by any suitable method, preferably brazing. The adapter 34 is annular with an opening 36 through its center for water flow. A downstream section of the outer periphery of the adapter has external threads 38, which mate with the upstream end 28 of the spout extension 18. This connection is threaded and thus the spout extension 18 can be removed from the spout 12. A known thread locking material or adhesive (e.g., an NSF61 approved high-strength permanent threadlocker such as Loctite® RC680 from Henkel Loctite Corporation of Rocky Hill, Conn. or Permabond International Perma-Lok® ML-186 from Glotrax Polymers, Inc. of Ontario, Canada) could be applied to the threads to make it more tamper resistant. Or, the connection could be made permanent by brazing or other technique, with our without the threads.

The seal 20, cartridge 22 and retainer 24 all fit within the cavity defined by the spout extension 18. The seal 20 can be made of any suitable resilient or gasket material and is preferably placed between the adapter 38 and the cartridge 22, as shown in FIG. 4, to ensure the water leaving the spout flows through the cartridge 22 and to prevent back flow through the threads of the adapter in the event of a back pressure situation.

The cartridge 22 is a small, self-contained insert containing the multiple elements, such as a flow regulator and spaced apart screens and perforated disks. The internal elements of the cartridge 22 are not shown in the drawings and are not discussed in detail here because the cartridge is a known component, commercially available from Neoperl, Inc. of Waterbury, Conn. In one preferred form, the cartridge is a Neoperl "Perlator Tom Thumb" model providing pressure compensated, laminar flow at 2.2 gallons per minute. It is noted, however, that the cartridge 22 has a generally cylindrical body (with stepped diameters) that fits within the spout extension 18 and can pass therethough when the retainer 24 is removed. Also, the top and bottom ends of the cartridge body are circular disks with many small openings 40 allowing water to pass from the spout 12 through the cartridge and out of the spout extension 18. As noted, the cartridge 22 can include flow smoothing elements that provide a smooth, clear laminar flow or create turbulence and low pressure in the flow stream resulting in a softer, bubbly stream exiting the spout extension 18. An aerating cartridge of the same overall diameter is also commercially available from Neoperl, under the same "Tom Thumb" model name, although of an aerator type. If necessary, air passageways (not shown) can be included in the retainer 24 to better allow air to flow to the low pressure area and aspirate the water stream.

As mentioned, the cartridge 22 is secured within the spout extension 18 by the retainer 24, which is a generally annular nut with a central opening 42. The retainer 24 supports the cartridge 22 from the downstream side. That is, the cartridge 22 rests on top of the retainer 24. The retainer 22 does not extend above the cartridge 22. Nor does it extend along the outermost diameter of the cartridge 22 and thus does not add to its diameter. Rather, the retainer 24 is almost entirely to one (downstream) side of the cartridge 22 except that an upstream section of the retainer 24 defines a shoulder 44 sized to receive a reduced diameter section 46 of the cartridge 22 so that these components inter-fit with each other. The upstream section of the retainer 24 also has external threads 48 at its outer periphery. These threads 48 mate with threads 32 of the spout extension 18 and are of a diameter slightly larger than a downstream section of the retainer 24. This downstream section defines a key acceptor (see FIG. 2) defined by two keyway slots 52 spaced apart 180 degrees. The keyway slots 52 mate with notched corners 54 at a narrow working end 56 of the key 26. As such, the working end 56 of the key 26 can fit up into the spout extension 18 and engage the slots 52 of the retainer 24, which is recessed back from the downstream end 30 of the spout extension 18, as shown in FIG. 4. With the retainer 24 recessed back from the end of the spout extension 18 in this manner, it is not readily noticeable or able to be turned by hand or conventional tools, thereby making it less likely to be tampered with. The retainer 24 is difficult to remove without the key 26, but with the key 26, the retainer 24 can be easily rotated and loosened so that the cartridge 22 can be accessed and removed from the spout extension 18 without removing the spout extension 18 from the spout 12. The retainer 24 is easily tightened again using the key 26.

FIGS. 6–8 illustrate another embodiment of the invention. This embodiment is identical to the aforementioned embodiment except for the configuration of the spout, adapter and spout extension. As such, the elements will be referenced as stated above, albeit with the suffix "A".

Specifically, FIG. 6 shows a faucet 10A with a low profile, generally straight spout 12A having a downwardly bent open end 16A to which the assembly 14A is attached. Referring to FIGS. 7 and 8, the assembly 14A includes a brass housing or spout extension 18A containing a seal 20A, an aerating or laminarizing cartridge 22A and a retainer nut 24A and a separate key tool (identical to that shown in FIG. 3) for securing and removing the retainer 24A.

While the spout extension 18A is an internally threaded brass cylinder, it has a slightly larger outer diameter (than described above) to match the larger spout and its inner diameter at an upstream 28A end is slightly larger than its downstream end 30A. The threads at the upstream end 28A mate with a brass adapter 34A partially inserted and brazed into the open end 16A of the spout 12A. The adapter 34A is generally annular like above, but here it has a back wall 60 defining an opening 36A for water flow. A downstream section of the outer periphery of the adapter 34A has external threads 38A, which mate with the upstream end 28A of the spout extension 18A.

The seal 20A, cartridge 22A and retainer 24A are all identical to that described above and all fit within the cavity defined by the spout extension 18A. However, since the spout 12A and adapter 34A are of slightly larger diameter, the seal 20A and an upstream end of the cartridge 22A fit within the adapter 34A. Like above, the retainer 24A supports the cartridge 22A from its downstream side. It does not extend along the outermost diameter of the cartridge 22A, but is almost entirely to the downstream side of the cartridge 22A except for the small overlap of the a reduced diameter section of the cartridge 22A and the retainer 24A.

As before, the retainer 24A in recessed back from the downstream end of the spout extension 18A when assembled and is turned by the key, which can fit up into the spout extension 18A and engage slots 52A.

It should be appreciated that preferred embodiments of the invention have been described above. However, many modifications and variations to these preferred embodiments will be apparent to those skilled in the art, which will be within the spirit and scope of the invention. For example, while the drawings show the cartridge, retainer and seal disposed within a separate spout extension, these elements could instead be placed directly within the spout itself provided it has an internally threaded section for the retainer to engage. Thus, the unique aspect of the invention in which the retainer is almost entirely to one side of the cartridge could be incorporated into other constructions. And, while the two embodiments described herein project water in a generally downward direction, the flow modifier assembly of the present invention is capable of operating in upwardly projecting spouts as well. Therefore, the invention should not be limited to the described embodiments. To ascertain the full scope of the invention, the following claims should be referenced.

Industrial Applicability

Disclosed is an improved tamper resistant flow modifier assembly for a plumbing fixture.

I claim:

1. A tamper-resistant flow modifier assembly for attachment to a faucet spout, the assembly comprising:

a housing defining a threaded cavity;

a flow modifying element disposed in the cavity;

a retainer insertable via a downstream end of the cavity to support the flow modifying element from a downstream side, the retainer having a key acceptor and threads mating with the housing and being recessed within the cavity, wherein the key acceptor is configured for altering the connection of the retainer to the housing.

2. The assembly of claim 1, wherein an open end of the cavity is threaded and the retainer is disposed at a side of the flow modifying element with the open end.

3. The assembly of claim 2, wherein the cavity has internal threads and the retainer is annular and has threads along at least a portion of its periphery.

4. The assembly of claim 1, wherein the housing is attached at an upstream end to a spout.

5. The assembly of claim 4, wherein the housing is cylindrical and internally threaded at each end.

6. The assembly of claim 5, wherein the upstream end of the housing is threaded onto an end of the spout.

7. The assembly of claim 4, further comprising an annular adapter coupling the spout and the housing.

8. The assembly of claim 7, wherein an upstream end of the adapter fits inside the spout and a downstream end of the adapter has threads about its periphery.

9. The assembly of claim 8, wherein the housing and spout have substantially the same outer diameters adjacent a joint between them.

10. The assembly of claim 1, further including a seal disposed in the cavity upstream from the flow modifying element.

11. The assembly of claim 1, wherein the flow modifying element is in cartridge.

12. The assembly of claim 11, wherein the retainer and the cartridge have inter-fitting ends.

13. The assembly of claim 1, wherein the flow modifying element is laminarizing element.

14. The assembly of claim 1, wherein the flow modifying element is an aerator element.

15. A tamper-resistant combined spout and flow modifier assembly, comprising:

a tubular spout extension defining a cavity with internal threads at a downstream end and being coupled at an upstream end to an open end of a spout;

a flow modifying cartridge disposed in the cavity;

an annular retainer supporting the cartridge from a downstream side and threaded to the spout extension to be recessed inside the cavity, wherein the retainer has a key acceptor that is set back from a downstream end of the spout extension that can be engaged by a key for rotation of the retainer for altering the connection of the retainer to the spout extension.

16. The assembly of claim 15, wherein the spout extension has essentially the same outer diameter as the open end of the spout adjacent a joint therebetween.

17. The assembly of claim 15, further including a threaded adapter coupling the spout extension to the spout.

18. The assembly of claim 17, further including a key for rotating the retainer.

19. The assembly of claim 7, further including a thread locking material disposed between mating threads of the adapter and the housing.

* * * * *

UNITED STATES PATENT AND TRADEMARK OFFICE

CERTIFICATE OF CORRECTION

PATENT NO. : 6,971,591 B2
APPLICATION NO. : 10/272752
DATED : December 6, 2005
INVENTOR(S) : Gary A. Fleischmann It is certified that error appears in the above-identified patent and that said Letters Patent is hereby corrected as shown below:

Col. 6, lines 32 - 65, replace Claims 18-19 with Claims 10-20 below:

-- 10. The assembly of claim 9, wherein the outer diameter of the housing is less than 0.75 inches.

11. The assembly of claim 1, further including a seal disposed in the cavity upstream from the flow modifying element.

12. The assembly of claim 1, wherein the flow modifying element is in a removable cartridge.

13. The assembly of claim 12, wherein the retainer and the cartridge have inter-fitting ends.

14. The assembly of claim 1, wherein the flow modifying element is laminarizing element.

15. The assembly of claim 1, wherein the flow modifying element is an aerator element.

16. A tamper-resistant combined spout and flow modifier assembly, comprising:
a tubular spout extension defining a cavity with internal threads at a downstream end and being coupled at an upstream end to an open end of a spout;
a flow modifying cartridge disposed in the cavity;
an annular retainer supporting the cartridge from a downstream side and threaded to the spout extension to be recessed inside the cavity,
wherein the retainer has a key acceptor that is set back from a downstream end of the spout extension that can be engaged by a key for rotation of the retainer for altering the connection of the retainer to the spout extension.

UNITED STATES PATENT AND TRADEMARK OFFICE

CERTIFICATE OF CORRECTION

PATENT NO. : 6,971,591 B2
APPLICATION NO. : 10/272752
DATED : December 6, 2005
INVENTOR(S) : Gary A. Fleischmann It is certified that error appears in the above-identified patent and that said Letters Patent is hereby corrected as shown below:

17. The assembly of claim 16, wherein the spout extension has essentially the same outer diameter as the open end of the spout adjacent a joint therebetween.

18. The assembly of claim 16, further including a threaded adapter coupling the spout extension to the spout.

19. The assembly of claim 18, further including a key for rotating the retainer.

20. The assembly of claim 7, further including a thread locking material disposed between mating threads of the adapter and the housing.-

Signed and Sealed this

Twenty-fifth Day of July, 2006

JON W. DUDAS
*Director of the United States Patent and Trademark Office*

UNITED STATES PATENT AND TRADEMARK OFFICE

CERTIFICATE OF CORRECTION

PATENT NO. : 6,971,591 B2
APPLICATION NO. : 10/272752
DATED : December 6, 2005
INVENTOR(S) : Gary A. Fleischmann It is certified that error appears in the above-identified patent and that said Letters Patent is hereby corrected as shown below:

Col. 6, lines 32 - 65, replace Claims 10-19 with Claims 10-20 below:

-- 10. The assembly of claim 9, wherein the outer diameter of the housing is less than 0.75 inches.

11. The assembly of claim 1, further including a seal disposed in the cavity upstream from the flow modifying element.

12. The assembly of claim 1, wherein the flow modifying element is in a removable cartridge.

13. The assembly of claim 12, wherein the retainer and the cartridge have inter-fitting ends.

14. The assembly of claim 1, wherein the flow modifying element is laminarizing element.

15. The assembly of claim 1, wherein the flow modifying element is an aerator element.

16. A tamper-resistant combined spout and flow modifier assembly, comprising:
a tubular spout extension defining a cavity with internal threads at a downstream end and being coupled at an upstream end to an open end of a spout;
a flow modifying cartridge disposed in the cavity;
an annular retainer supporting the cartridge from a downstream side and threaded to the spout extension to be recessed inside the cavity,
wherein the retainer has a key acceptor that is set back from a downstream end of the spout extension that can be engaged by a key for rotation of the retainer for altering the connection of the retainer to the spout extension.

UNITED STATES PATENT AND TRADEMARK OFFICE

CERTIFICATE OF CORRECTION

PATENT NO. : 6,971,591 B2
APPLICATION NO. : 10/272752
DATED : December 6, 2005
INVENTOR(S) : Gary A. Fleischmann It is certified that error appears in the above-identified patent and that said Letters Patent is hereby corrected as shown below:

17. The assembly of claim 16, wherein the spout extension has essentially the same outer diameter as the open end of the spout adjacent a joint therebetween.

18. The assembly of claim 16, further including a threaded adapter coupling the spout extension to the spout.

19. The assembly of claim 18, further including a key for rotating the retainer.

20. The assembly of claim 7, further including a thread locking material disposed between mating threads of the adapter and the housing.--

This certificate supersedes Certificate of Correction issued July 25, 2006.

Signed and Sealed this

Second Day of January, 2007

JON W. DUDAS
*Director of the United States Patent and Trademark Office*